United States Patent [19]

Bousquet et al.

[11] Patent Number: 5,073,309

[45] Date of Patent: Dec. 17, 1991

[54] DEVICE FOR DISPERSION OF GAS IN A LIQUID PHASE

[75] Inventors: Jacques Bousquet, Irigny; Alain Catros, Rillieux La Patte; Le Xuan Huynh, Bruxelles; Alain Secq, Pont L'Eveque, all of France

[73] Assignee: Elf France, Paris, France

[21] Appl. No.: 392,952

[22] PCT Filed: Oct. 27, 1988

[86] PCT No.: PCT/FR88/00526

§ 371 Date: Jul. 21, 1989

§ 102(e) Date: Jul. 21, 1989

[87] PCT Pub. No.: WO89/04208

PCT Pub. Date: May 18, 1989

[30] Foreign Application Priority Data

Nov. 3, 1987 [FR] France ..... 87 15219

[51] Int. Cl.[5] ..... B01F 3/04

[52] U.S. Cl. ..... 261/29; 261/76; 261/DIG. 75

[58] Field of Search ..... 261/DIG. 75, 76, 29

[56] References Cited

U.S. PATENT DOCUMENTS

| | | | |
|---|---|---|---|
| 2,771,998 | 11/1956 | Holden | 261/76 |
| 2,940,168 | 6/1960 | Monroe | 261/112.2 |
| 3,094,171 | 6/1963 | Gagliardo | 261/DIG. 26 |
| 3,256,802 | 6/1966 | Karr | 261/DIG. 75 |
| 3,347,381 | 10/1967 | Minch et al. | 261/112.2 |
| 4,123,800 | 10/1978 | Mazzei | 366/150 |
| 4,124,660 | 11/1978 | Sterlini | 261/DIG. 75 |
| 4,278,405 | 7/1981 | Angle | 261/DIG. 75 |
| 4,308,138 | 12/1981 | Woltman | 261/DIG. 75 |
| 4,411,780 | 10/1983 | Suzuki et al. | 261/DIG. 75 |
| 4,416,610 | 11/1983 | Gallagher, Jr. | 137/888 |
| 4,564,480 | 1/1986 | Kamelmacher | 261/DIG. 75 |
| 4,701,194 | 10/1987 | Weyers et al. | 261/DIG. 75 |
| 4,722,363 | 2/1988 | Allyn | 137/888 |
| 4,742,584 | 5/1988 | Abe | 261/DIG. 75 |
| 4,749,527 | 6/1988 | Rasmusen | 261/76 |
| 4,820,408 | 4/1989 | Sandig | 261/DIG. 75 |

FOREIGN PATENT DOCUMENTS

| | | | |
|---|---|---|---|
| 1078092 | 3/1960 | France | 261/DIG. 75 |
| 3218227 | 11/1983 | France . | |
| 3247912 | 6/1984 | France . | |
| 111720 | 12/1917 | United Kingdom | 261/DIG. 75 |

*Primary Examiner*—Tim Miles

*Attorney, Agent, or Firm*—Burgess, Ryan & Wayne

[57] ABSTRACT

A device for dispersing a gaseous phase in a liquid phase comprises at least one Venturi ejector with a vertical or inclined axis, composed of a mixer head (1) for admitting the liquid, a neck (2) for admitting the gas, and an injector tube (3). The injector tube is prolonged by a chamber (5) whose diameter is equal to or greater than that of the injector tube with which it possibly merges. Also described is the application of this device to treatments such as chemical, biochemical or metabolic reactions involving the transfer of a gas to a liquid phase.

11 Claims, 5 Drawing Sheets

DEVICE FOR DISPERSION OF GAS IN A LIQUID PHASE

BACKGROUND OF THE INVENTION

1. Field of the Invention

The invention is a device for transfer from a gaseous to a liquid phase. The gaseous phase dissolves in the liquid phase and subsequently reacts in the liquid phase.

This device is designed mainly to carry out treatments such as chemical, biological and metabolic reactions that include the transfer from a gaseous phase to a liquid phase. The liquid phase can be industrial or potable water.

Many treatments make use of chemical or biological transformations which require the inclusion, in the reaction medium of a gaseous composition needed for the chemical, biochemical and metabolic reactions of the microorganisms present in the reaction medium that the liquid phase represents. The device of the invention is particularly useful for aerobic treatment of water. To be effective, the systems require intimate mixing of the two phases.

2. Related Art

There are known devices such as surface aerators having stationary or floating turbines, which may run slow or fast, or use brushes, immersed systems which require injection of air such as static ventilators, vibrator valves and porous atomisers and the circulating systems using self-priming pumps with stationary or mobile jets.

The known devices provide homogeneous mixtures at the expense of a high consumption of energy.

There are known devices that use a venturi ejector to ensure the aeration of the liquid phase. They are more economical in energy consumption than the devices cited above.

The intrinsic performances of aeration equipment can be appraised through two criteria, namely:

1) The specific utilization of kilograms of oxygen per kilowatt-hour; and

2) The transfer coefficient in seconds $^{-1}$.

The transfer coefficient by definition relates to the rate of variation of concentration to the difference between the concentration and the concentration corresponding to that of saturation of the gaseous phase in the liquid phase. The apparatus customarily used has raw specific utilization generally between 0.8 and 1.8 kilograms of oxygen per kilowatt-hour.

A study made by WANG, et al in 1978, and published in Chem. Eng. Sci., 33,945 in 1978, showed that coefficients of transfer as high as 0.22 second $^{-1}$ could be obtained by using bubble columns equipped with static mixers for velocities of liquid and of gas respectively equal to 0.17 meter per second and 0.25 meter per second. The most popular devices which are the classical venturi or the porous atomiser, make it possible to obtain transfer coefficients between about 0.06 and 0.13 second $^{-1}$.

BRIEF DESCRIPTION OF THE INVENTION

The object of this invention is to improve the performance of the devices for transfer from a gaseous phase to a liquid phase. According to the invention, a device for dispersion of a gaseous phase in a liquid phase comprises at least one venturi ejector comprising a convergent nozzle for admitting a liquid, a neck with means for admitting a gas, a divergent nozzle, and an extension of the divergent nozzle with an extension piece of a diameter equal to or larger than the diameter of the end of the divergent nozzle in communication with the end of the divergent nozzle. The device is used in a substantially vertical position, with the flow of the liquid phase in a downward direction.

The device is immersed in the liquid phase.

DETAILED DESCRIPTION OF THE INVENTION

The liquid phase is introduced by a pump to the inlet of the convergent nozzle at an initial velocity adapted to the venturi. The gaseous phase is introduced into the neck of the venturi. The gaseous phase can be absorbed by the liquid phase, which then plays the part of driving fluid, or introduced by the combined action of pressure and suction due to the flow of the liquid phase. The divergent nozzle ensures a mixture of both phases. The extension piece placed at the exit of the divergent nozzle reinforces the effect of the venturi by providing a large zone of contact in a relatively confined space, which makes it possible to obtain better gas/liquid transfer than obtained by the known processes. In addition, it is possible to make the extension piece larger in diameter than the exit of the divergent nozzle. In this case, the divergent nozzle and the extension piece are no longer joined and the flow of the mixture in the extension piece induces circulation of part of the liquid phase in which the device is immersed. The added circulation effect will be useful any time the amount of gas contained in the mixture liquid phase/gaseous phase is larger than the capacity of the liquid phase entering the convergent nozzle to absorb the gas.

In an embodiment of the invention, a connecting intermediary cylindrical piece is inserted between the exit of the divergent nozzle and the inlet of the extension piece. The intermediary piece contains apertures on its exterior surface that puts in communication the interior of the intermediary piece and the liquid phase in which the device is immersed. The velocity of flow of the mixed liquid phase and gaseous phase in the intermediary piece induces the suction of part of the external liquid phase into the flowing mixed phases.

The nature of the material or materials from which the device is fabricated has no influence on the effectiveness of the device. It is the nature of the phases that are present which determines the material to be used. The connections of the device to the different pipes can be of any type, such as welded, glued, clamped or screwed.

The venturi is designed in a manner such that the velocity of the flow in the extension piece ensures that the gas bubbles are subjected to two influences; the descending flow of the mixture and the Archimedean force, and the ascending force on the bubbles, making it possible for said bubbles to be dissolved to the maximum by the liquid phase.

Tests conducted with the device of the invention have provided transfer coefficients that can reach 0.35 second $^{-1}$, far above transfer coefficients obtained by known devices.

The device of the invention can be used for any process which requires the transfer from a gaseous phase to a liquid phase, especially for the treatments of industrial or town water, stale or drinkable. The device is particularly useful for contacting with air or with enriched air, for oxygentation, for chlorination and for ozonation.

A plurality of devices can be arranged in a parallel connection; the number being dependent on the volume of liquid phase to be treated. Two or more devices can be arranged serially, especially when the conditions of absorption of the gaseous phase in the liquid phase are difficult. That is, when the solubility of the gaseous phase is low under the conditions provided for the treatment, or if an intervening reaction consumes the dissolved gas.

Other purposes and advantages of this invention will appear from the reading of the description that follows, which is non-limiting with reference to the drawings.

The device of the invention described by way of example has been designed for use in a basin with a surface of 400 square meters and a depth of 2.5 meters in which the oxygen requirements of the liquid phase are 51 kilograms per hour.

Figure 1A:
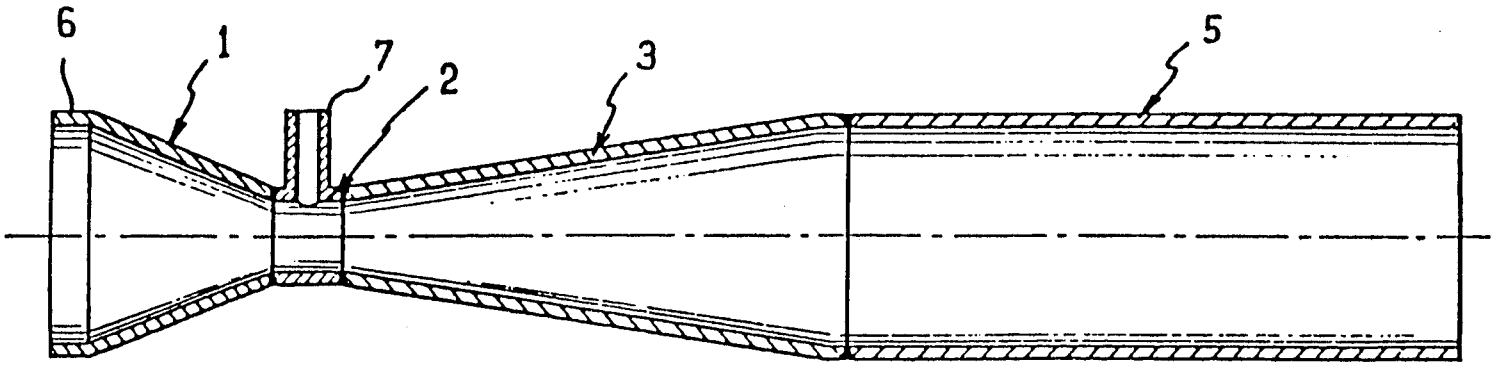
FIG. 1*a* is a view in longitudinal section of a device according to a first embodiment of the invention.

The device of FIG. 1*a*, includes a convergent nozzle 1 with an angle of about 40 degrees and a length of 127 millimeters. At the inlet side of the convergent nozzle, which serves as an inlet for the liquid phase, there is a cylindrical part 6 designed to connect to the pipes that introduce the liquid phase. The diameter of the inlet of the convergent nozzle 1 is equal to 114 millimeters.

After the convergent nozzle is the neck 2 of the venturi. It has a diameter of 25.4 millimeters and a length of 25.4 millimeters. The neck 2 includes equidistantly from its two ends, inlet connection 7 which is 50.8 millimeters in length and is meant for introducing the gaseous phase into the device. The internal diameter of the inlet connection is 8 millimeters.

The neck 2 is followed by the divergent nozzle 3 that forms an angle of 10 degrees. Its length is such that the diameter of the exit is equal to the diameter of the inlet of the convergent nozzle, and is 506 millimeters in length.

Next to the divergent nozzle 3 is the extension piece 5. The extension piece 5 is cylindrical. having a diameter equal to that of the exit of the divergent nozzle 3, and a length equal to 1030 millimeters.

Figure 1B:
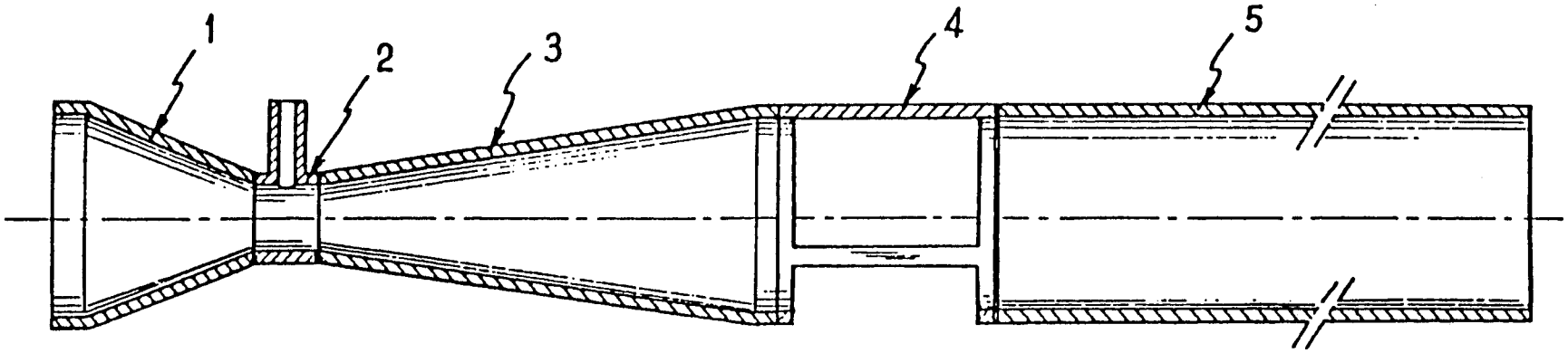
FIG. 1*b* is a view in longitudinal section of a device according to a second embodiment of the invention.

In a variant of the device shown in FIG. 1*b*, a spacer 4 is inserted between the venturi and the extension piece 5.

In a preferred embodiment its diameter is equal to 114 millimeters, its length to 114 millimeters. The spacer is perforated by three apertures in its side walls. The diameter of the aperture is compatible with the design of the device.

Figure 2:
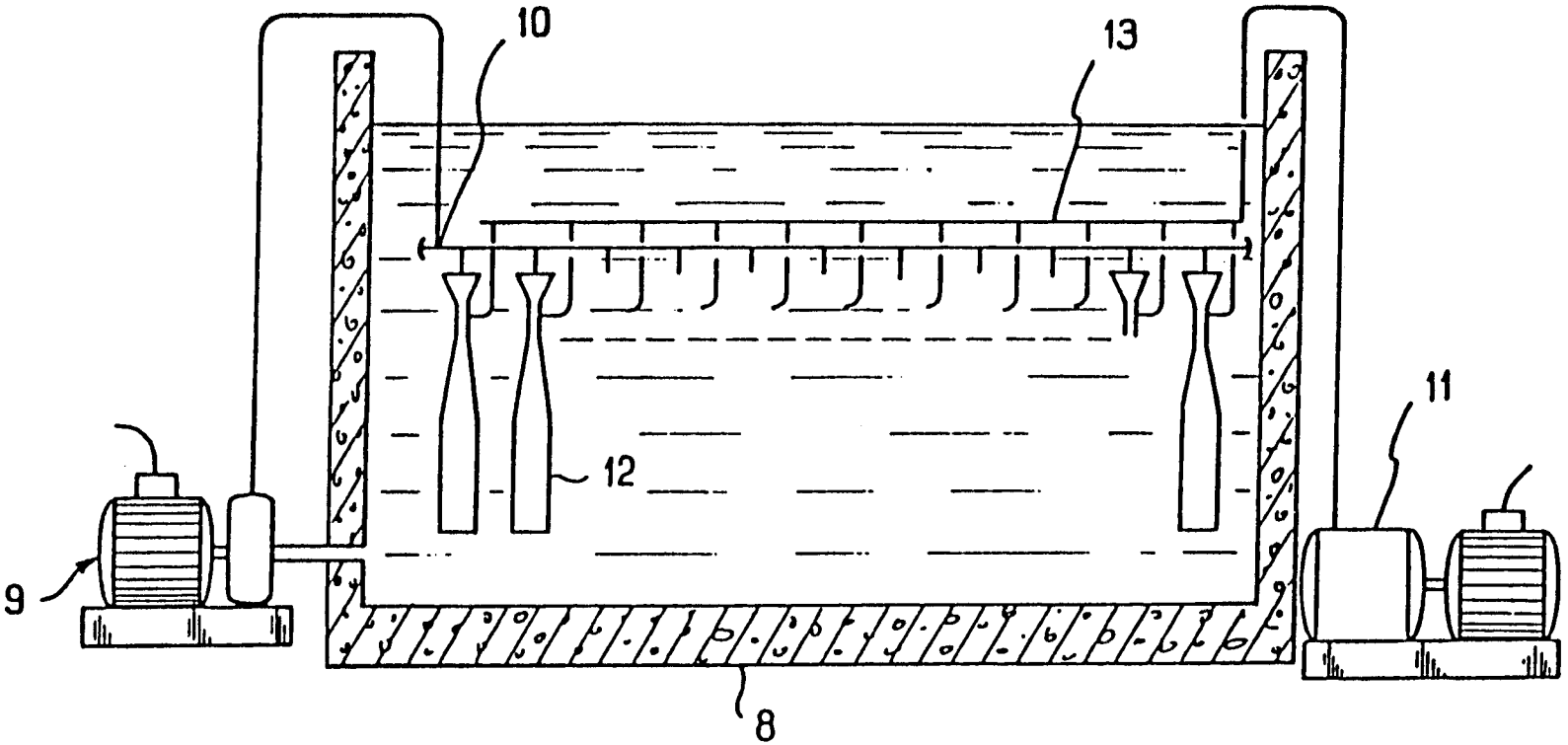
FIG. 2 illustrates an application of the invention in a parallel arrangement.

FIG. 2 is an illustration of an installation wich utilizes the device described above. In the basin 8, the liquid phase is circulated to the device of the invention 12 by means of a pump 9 and of a feed header 10. In the same manner the gaseous phase is introduced at the neck of the devices 12 by means of a compressor 11 and of a feed header 13. The basin has a capacity of 1000 cubic meters, the pump 9 has a delivery ratio of 2400 cubic meters per hour at a pressure of 1 bar, the compressor 11 delivers 3.3 cubic meters of air per minute at a pressure of 0.4 bar.

The installation is preferably equipped with 263 devices, each one arranged substantially vertically. It ensures an oxygenation capacity of 51 grams of oxygen per cubic meter per hour. The rough power required is 30 kilowatts, that is, a specific power of 30 watts per cubic meter.

Figure 3:
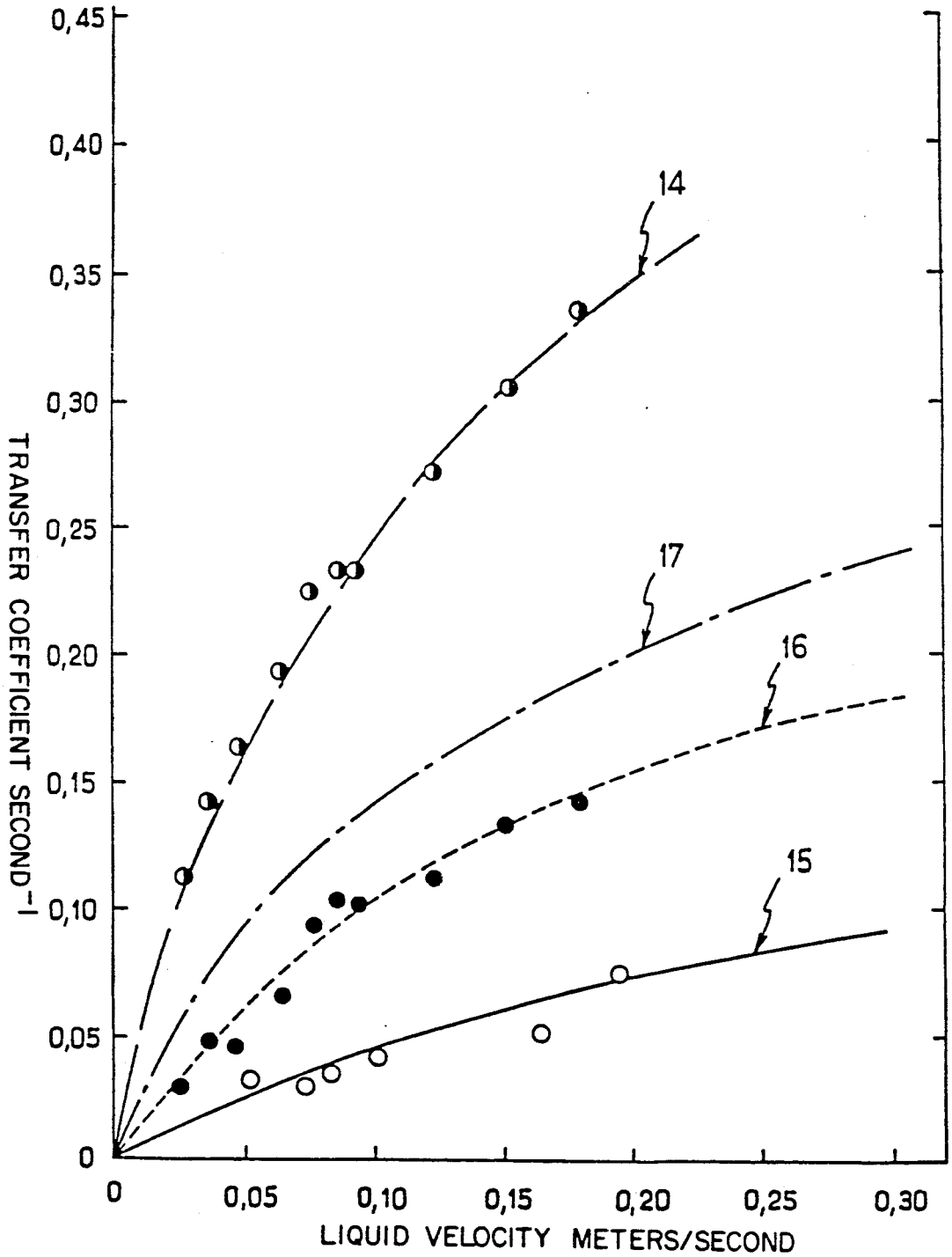
FIG. 3 presents several curves showing the variation of the transfer coefficient as a function of the velocity of the liquid phase, at the time of measurements taken in part by the inventors and in part by WANG, et al in Chem. Eng. Sci., 33, 945 (1978)

FIG. 3 is a comparison of the values of the transfer coefficients as a function of the velocity of the liquid phase; namely, 0.2624 meters per second of the device of the invention, curve 14; and the coefficients obtained by using the known devices, curve 15 (porous plate); 16 (classical venturi); and 17 (bubbles column and static mixer).

Curves 16 and 17 were obtained by WANG, et al in 1978; the others have been experimentally obtained by the inventors. In the abscissae appear the superficial velocity of the liquid in meters per second; and in ordinates, appear the transfer coefficients in second $^{-1}$.

Figure 4:
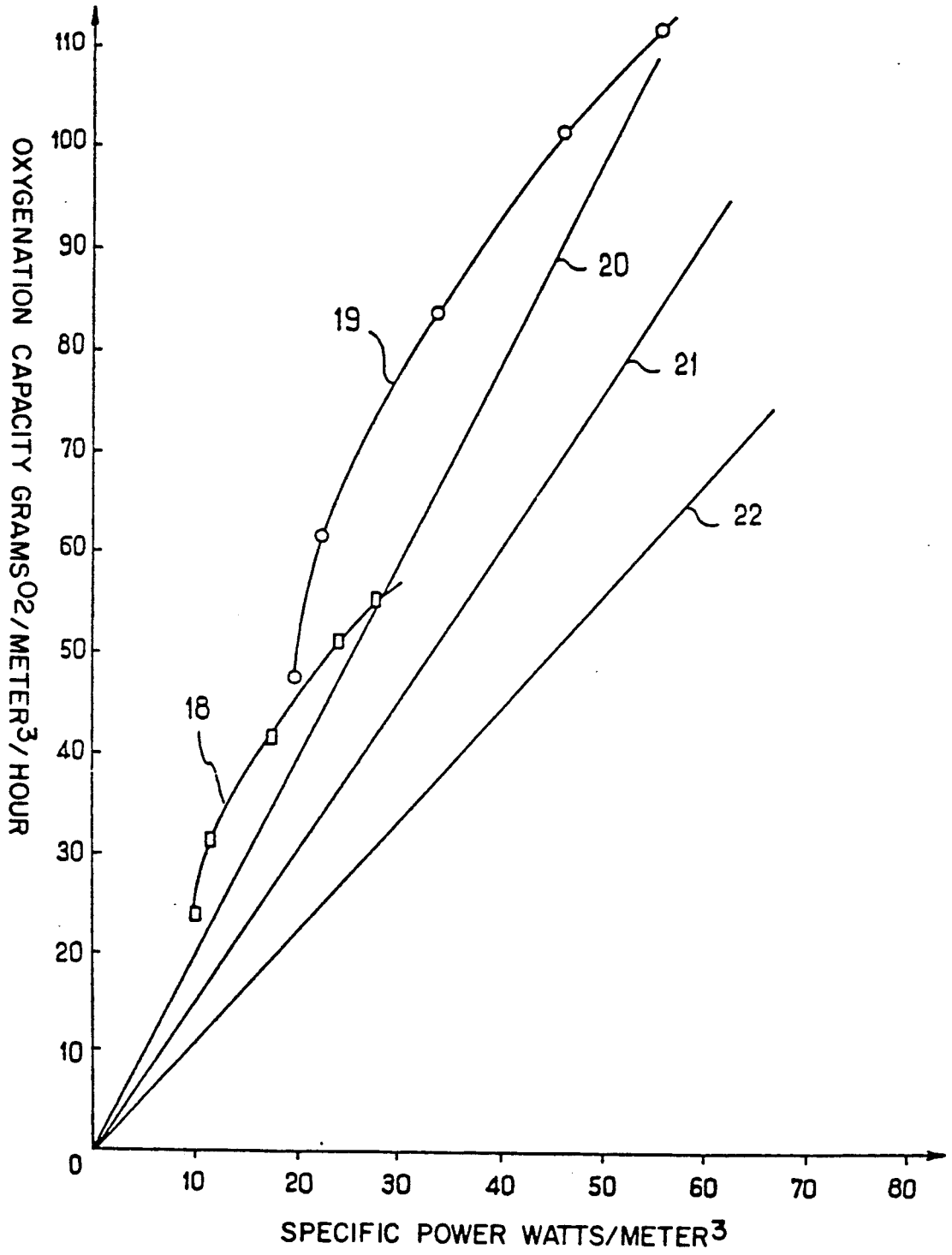
FIG. 4 presents several curves showing the variation of the oxygenation capacity of the devices of FIG. 1 as a function of the specific power established on the basis of results obtained in part by tests carried out by the inventors and in part by the results of a study of the Centre Technique Du Genie Rural des Eaux et Forets (CEMAGREF), and published by the French Ministry of Agriculture in 1980.

FIG. 4 presents a comparison of the values of the oxygenation capacities as a function of the specific power used by the device of the invention; curves 18 and 19 (delivery of the liquid phase equal to 2.5 liters per seond for curve 18, delivery of the liquid phase equal to 5 liters per second for curve 19, and the coefficients obtained by the known devices; curve 20 (maximum cover curve of the statistical values relative to turbines fast, slow and with brushes), 21 (brush slow turbine) and 22 (fast turbine). Curves 20, 21 and 22 have been determined with the data cited by CEMAGREF in 1980, the others have been determined experimentally by the inventors. The abscissae is the specific power in watts per cubic meter, the ordinates is the oxygenation capacity in grams of oxygen per cubic meter and per hour.

Each one of the devices described above is very effective. In certain cases and in the presence of certain fluids which are characterized by a low viscosity and/or a strong surface tension, or in the presence of certain occluded gases or a dispersed phase of low molecular weight, its utilization in a vertical position can result in an accumulation of gas or a coalescence thereof in the extension piece of the device.

The embodiments shown in FIGS. 5 to 8 differ from those described above in that they comprise, in addition. a packing in the extension piece that plays the part of a bubble breaker, and prevents the coalescence of the bubbles in the gas.

Figure 5:
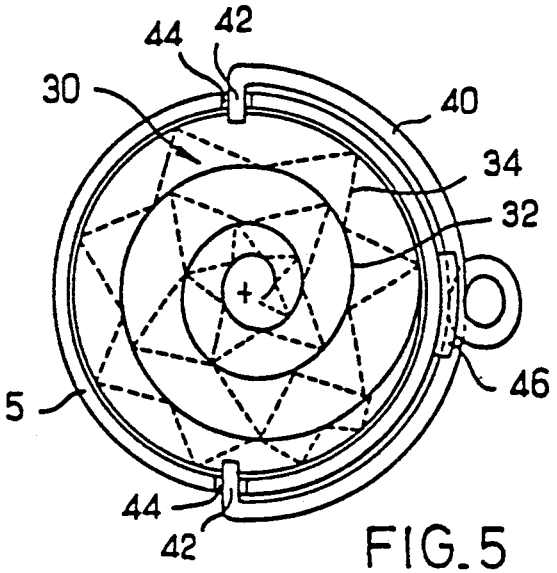
FIGS. 5 to 7 each represent a sectional view of a device according to a third embodiment of the invention.
Figure 9:
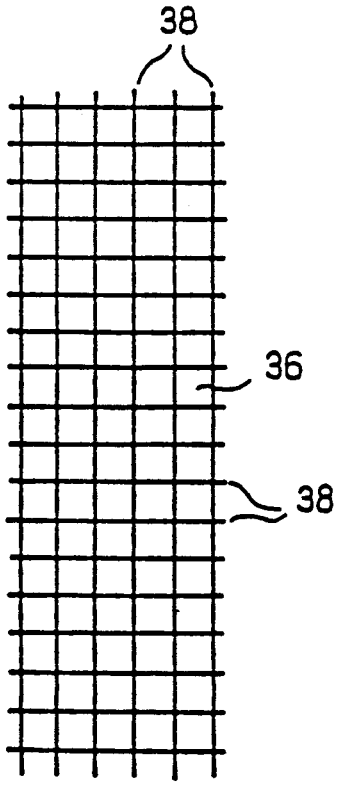
FIG. 9 is a view of a packing element.

As shown in FIG. 5, the device includes a packing 30 situated in the extension piece 5. The packing is formed by two elements 32 and 34, comprising each a lattice structure 36 such as shown in FIG. 9. The lattice structure 36 comprises two series of wires 38 orthogonally arranged forming square nets that are either welded or interlaced. The wires 38 can be, for example, plastic material, stainless steel, or can consist of plastic coated metallic wires.

The first element 32 of the packing 30 is formed by a lattice structure 36 which is wound to make it adopt a substantailly spiral shape. The second element 34 of the packing 30 is likewise formed by a lattice structure which is folded so as to have a section substantially serrated. Once folded, the lattice structure is wound to adopt a shape corresponding to that of the first element. Both elements 32 and 34 are preferably wound together. Once wound, the packing 30 is mounted inside the extension piece.

In order to retain the packing 30 in the extension piece 5, the packing can be formed with an external diameter which is between 1.10 and 1.20 times the internal diameter of the extension piece 5. In this case, the packing 30 is fitted by force in the extension piece 5. The packing 30 can be formed with an external diameter substantially equal to or slightly less than the internal diameter of the extension piece 5. In this case, the device comprises in addition a means for keeping the packing 30 in place in the extension piece 5. The devices shown in FIG. 5 to 7 include each a different means for holding the packing 30 in the extension piece. In the embodiment of FIG. 5, the packing 30 is held by a blocking spring 40, which is substantially C-shaped and includes at the ends two brackets 42 oriented toward the center of the C. The blocking spring 40 is mounted around the exterior of the extension piece 5, the brackets 42 passing through openings 44 formed in the extension piece 5 for engaging the nets of the element 32. The blocking spring 40 is held in place between two clamps 46 each one formed by bending up part of the sheet metal of the extension piece 5.

Figure 6:
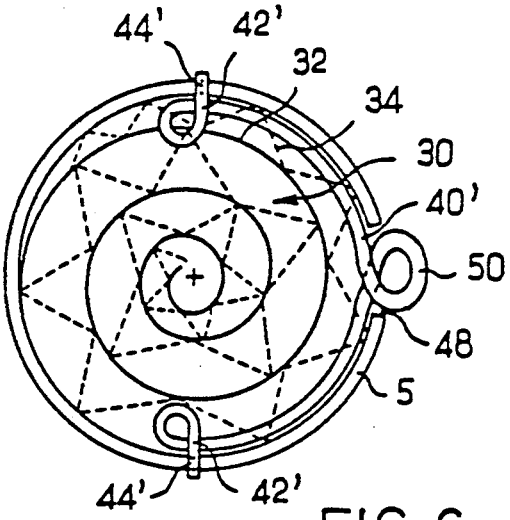

The embodiment of FIG. 6 differs from that of FIG. 5 in that the blocking spring 40' is mounted inside the extension piece 5. In this case, the brackets 42' are bent up toward the outside and pass through the openings 44' formed in the extension piece 5. A third opening 48 is formed in the extension piece and allows a part 50 shaped as a ring of the spring 40' to exit outside the extension piece 5. The blocking spring 40' is situated in the extension piece between the packing 30 and the exit of the extension piece 5.

Figure 7:
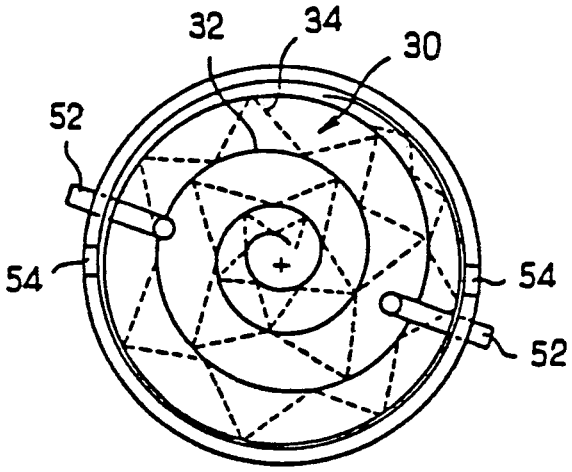

In the embodiment of FIG. 7 the packing 30 includes two bayonets 52 welded on the nets of the elements 32 and 34. The extension piece 5 is provided with two L-shaped recesses 54 designed to receive the bayonets 52, thus locking in place the packing 30.

Figure 8:
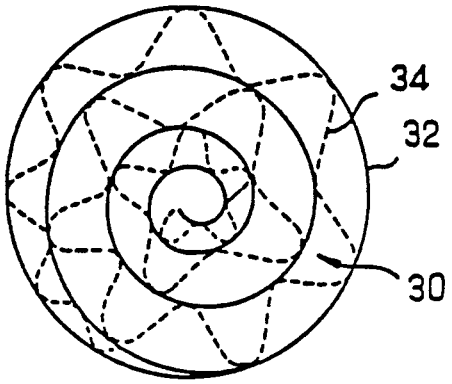
FIG. 8 is a sectional view of a variant of the device of FIGS. 5–7.

A second embodiment of the packing 30 is shown in FIG. 8. This packing differs from that of FIGS. 5 to 7, in that the second element is formed by a lattice structure to which a corrugated or substantially sinusoidal section has been previous joined.

In the embodiments of FIGS. 5 to 8 it has been provided that the axial length of the packing 30 is between about 10 to about 40% of the axial length of the extension piece 5.

The packing described above has the following advantages:

1) due to its very great porosity, the pressure drop created by the presence of the packing in the extension piece is very small;

2) the contact surface between the gas and the liquid is increased by breaking of the gas bubbles;

3) the gas-liquid transfer is improved, which results in a reduction of the viscosity of the liquid due to the large quantity of dissolved gas;

4) the packing allows free circulation of solid particles if the mesh is at least 5 times larger than the diameter of the particles; and 5) the packing reduces back mixing of the liquid making the flow of the latter closer to a piston flow.

The first element 32 of the packing 30 is meant to be used in a device having the dimensions of the device described above is preferably formed from square mesh having a side of 10 mm made from a wire having a diameter of 0.25 to 0.5 mm. The first element 32 has a serrated section, the length of each face is 14.14 mm and the angle between two adjacent faces is 90°. In the embodiment of FIG. 8, the length of the undulation of the corrugations is 20 mm and the width is 10 mm.

What is claimed is:

1. A device for the dispersion of a gaseous phase in a liquid phase, comprising a venturi ejector, oriented substantially vertically and arranged for downward flow of the liquid phase and immersion in the liquid phase, the venturi ejector comprising:

a convergent nozzle (1) for introduction of the liquid phase, a neck (2) connected to the convergent nozzle at a point of the same internal diameter as the convergent nozzle at the point of connection, the neck having means for the admission of the gas and a divergent nozzle (3) connected to the neck at a point of the same internal diameter as the neck at the point of connection wherein the divergent nozzle (3) is connected to a perforated cylindrical piece (4) of a diameter equal to the diameter of the exit of the divergent nozzle, having perforations of a length substantially equal to the diameter, the device is extended by an extension piece (5) of a diameter at least equal to the diameter of the perforated cylindrical piece, in communication with the perforated cylindrical piece.

2. A device according to claim 1, wherein the liquid phase is the driving fluid and the gaseous phase being absorbed.

3. A device according to claim 1, wherein the gaseous phase is injected under pressure into the liquid phase.

4. A device according to claim 1, wherein the extension piece (5) is at least as long as the length of the venturi ejector.

5. A device of claim 1, comprising plurality of venturi ejectors arranged in parallel.

6. A device of claim 1, wherein the venturi ejector is entirely immersed in the liquid phase.

7. A device of claim 1, comprising a packing (30) arranged in the extension piece (5), the packing (30) being formed by at least one lattice element (32, 34).

8. A device of claim 7 additionally including means for holding the packing (30) in place in the extension piece (5).

9. A device of claim 7, wherein the packing (30) is formed by two lattice elements (32, 34) which are wound together in the shape of a spiral.

10. A device of claim 9, wherein one of the elements (34) has a substantially serrated section.

11. A device of claim 9, wherein one of the elements (34) has a substantially sinusoidal section.

* * * * *